US008510977B1

(12) United States Patent
Cable

(10) Patent No.: US 8,510,977 B1
(45) Date of Patent: Aug. 20, 2013

(54) COMPOSITE MAGNETIC TAG

(76) Inventor: Ellen Cable, Madison, NJ (US)

( * ) Notice: Subject to any disclaimer, the term of this patent is extended or adjusted under 35 U.S.C. 154(b) by 0 days.

(21) Appl. No.: 13/534,176

(22) Filed: Jun. 27, 2012

(51) Int. Cl.
*G09F 7/04* (2006.01)

(52) U.S. Cl.
USPC ..... 40/611.01; 40/1.5; 40/6

(58) Field of Classification Search
USPC ..... 40/634, 600, 661.01, 1.5, 6
See application file for complete search history.

(56) References Cited

U.S. PATENT DOCUMENTS

| | | | | |
|---|---|---|---|---|
| 2,483,031 | A | 9/1949 | Avedon | |
| 2,623,256 | A | 12/1952 | Febelman | |
| 2,637,887 | A | 5/1953 | Goodman et al. | |
| 2,975,497 | A | 3/1961 | Budreck | |
| 3,086,268 | A | 4/1963 | Chaffin, Jr. | |
| 4,236,331 | A | 12/1980 | Mattson | |
| 4,592,157 | A * | 6/1986 | Kerr | 40/634 |
| 4,865,324 | A * | 9/1989 | Nesis | 273/155 |
| 5,347,733 | A | 9/1994 | Whittington | |
| 6,484,428 | B1 * | 11/2002 | Greenwald et al. | 40/600 |
| 2010/0192430 | A1 * | 8/2010 | Lawrence | 40/27.5 |

* cited by examiner

*Primary Examiner* — Casandra Davis
(74) *Attorney, Agent, or Firm* — Thomas J. Germinario

(57) ABSTRACT

A tripartite composite magnetic tag comprises a thin central ferromagnetic plate sandwiched between two magnetic outer panels, which bear graphic and/or alphanumeric indicia. The composite magnetic tag is attachable by a connective means to various personal items through a composite aperture. The magnetic outer panels are interchangeable with replacement panels bearing different indicia, such that the composite magnetic tag can serve multiple identification and/or decorative purposes.

3 Claims, 3 Drawing Sheets

COMPOSITE MAGNETIC TAG

BACKGROUND OF THE INVENTION

The present invention relates to the field of tags that are attachable for identification and/or decorative purposes to personal items, such as key chains, backpacks, laptop computers, cell phones, briefcases, luggage or articles of clothing. More specifically, the present invention relates to such tags wherein the identification and/or decorative elements are replaceable and/or interchangeable magnetic panels.

The use of attachable tags to identify the owner of personal items and/or to enhance their appearance is widespread and growing with the proliferation of portable electronic devices. Such tags have also increasingly become items of personal style, through which the owner can display their interests in sports, music and other aspects of popular culture. For example, a high school athlete might want to have a tag depicting lacrosse sticks attached to his/her sports bag when he/she is participating in a lacrosse match. But the same athlete might want to have his/her bag tag display a basketball when he/she is participating in that sport. It would therefore be advantageous to have a tag in which the identification/decorative elements are interchangeable, so that a single tag could serve multiple purposes and display multiple interests of the owner.

The present invention provides a tag with a composite structure comprising two indicia-bearing magnetic panels, which are removably attachable to a central ferromagnetic metallic plate. In use, the middle metallic plate is retained, while the outer panels can be interchanged to alter the outward appearance of the tag as desired.

SUMMARY OF THE INVENTION

The present invention is a tripartite composite magnetic tag, comprising two substantially congruent outer magnetic panels and a substantially congruent central ferromagnetic plate. The magnetic outer panels have a magnetic interior side and a concave "domed" exterior side, preferably made of a resin plastic, bearing graphic and/or alphanumeric indicia. The central ferromagnetic plate is a thin plate made of ferromagnetic metal, preferably stainless steel, and it substantially conforms to the size and shape of the two outer magnetic panels.

Each of the two outer magnetic panels attaches by its magnetic interior side to either face of the central ferromagnetic plate, thereby forming a composite "sandwich" tag, in which the indicia-bearing exterior sides of the outer magnetic panels are visible. Each of the two outer magnetic panels has a circular aperture which aligns cooperatively with corresponding apertures of the other outer magnetic panel and of the central ferromagnetic plate to form a composite aperture, such that the assembled composite tag can be attached to one or more other items by a connective means, such as a cord, ring, chain or clip, inserted through the composite aperture.

The foregoing summarizes the general design features of the present invention. In the following sections, a specific embodiment of the present invention will be described in some detail. This specific embodiment is intended to demonstrate the feasibility of implementing the present invention in accordance with the general design features discussed above. Therefore, the detailed description of this embodiment is offered for illustrative and exemplary purposes only, and it is not intended to limit the scope either of the foregoing summary description or of the claims which follow.

DETAILED DESCRIPTION OF THE PREFERRED EMBODIMENT

Figures 1A, 1B, 1C:
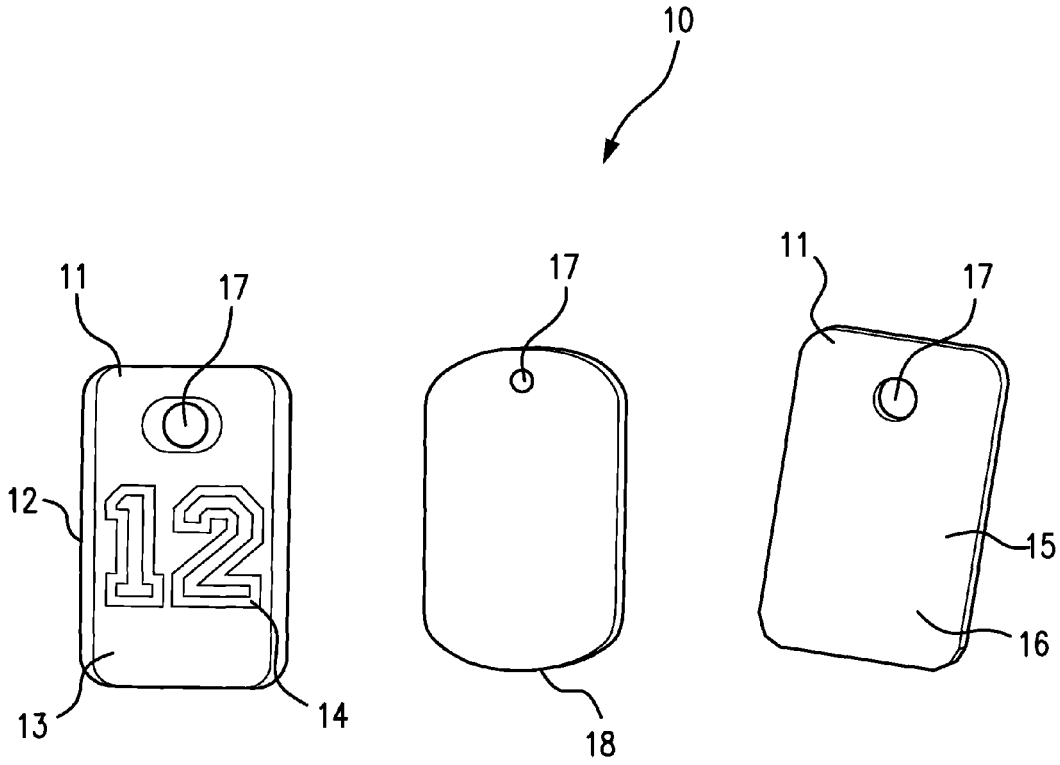
FIG. 1A is a plan view of the exterior side of one of the magnetic outer panels of a composite magnetic tag according to the preferred embodiment of the present invention.
FIG. 1B is a plan view of the interior side of one of the magnetic outer panels of a composite magnetic tag according to the preferred embodiment of the present invention.
FIG. 1C is a plan view of the central ferromagnetic plate of a composite magnetic tag according to the preferred embodiment of the present invention.

Referring to FIGS. 1A, 1B and 1C, the outer magnetic panels 11 of the composite tag 10 are rectangular with rounded corners, preferably with a long-side length of 1.5 to 2.5 inches and short-side width of 0.75 to 1.25 inches. The exterior side 12 of each outer panel 11 has a concave "domed" resin plastic surface 13 bearing graphic and/or alphanumeric indicia 14. The interior side 15 of each outer panel 11 comprises a magnetic surface 16.

The upper portion of each outer panel 11 has a circular aperture 17, which aligns cooperatively with corresponding apertures 17 in the other outer panel 11 and the central ferromagnetic plate 18. As shown in FIG. 1C, the central ferromagnetic plate 18 substantially conforms to the shape and dimensions of the outer panels 11, and is preferably made of a thin gauge polished stainless steel.

Optionally, the central ferromagnetic plate 18 can contain identity information regarding the owner of the tagged item, such as name, address, phone and/or e-mail. In this alternative, the outer panels 11 would also serve to conceal the engraved identity information from public view.

Figure 2:
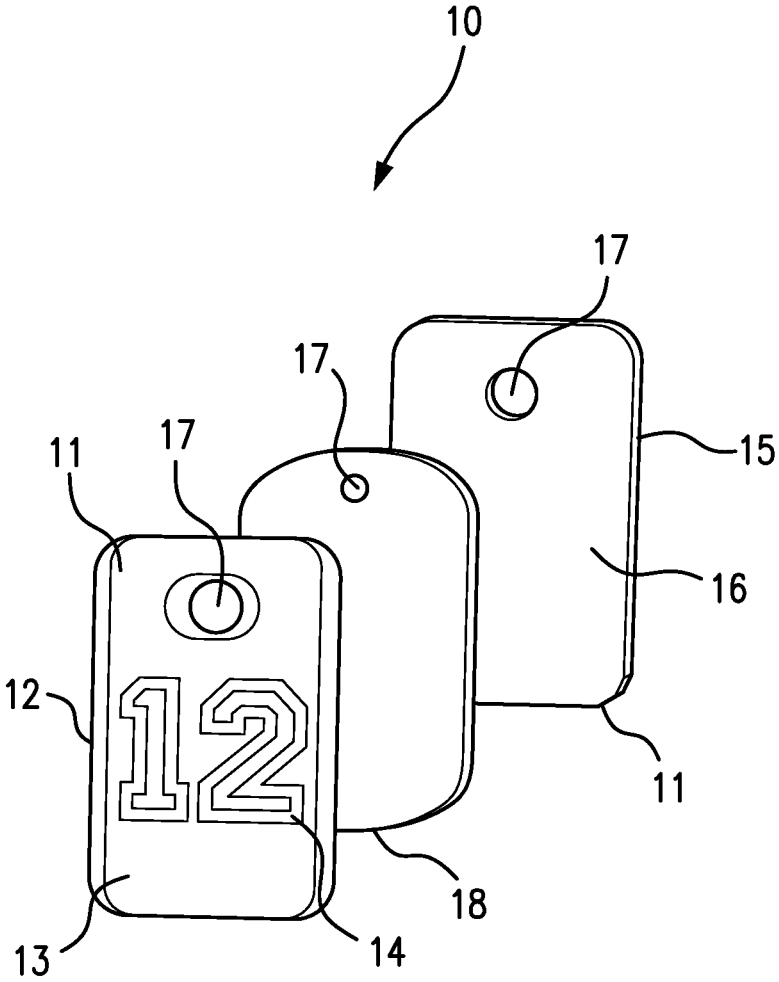
FIG. 2 is an exploded view of a composite magnetic tag according to the preferred embodiment of the present invention.
Figure 3:
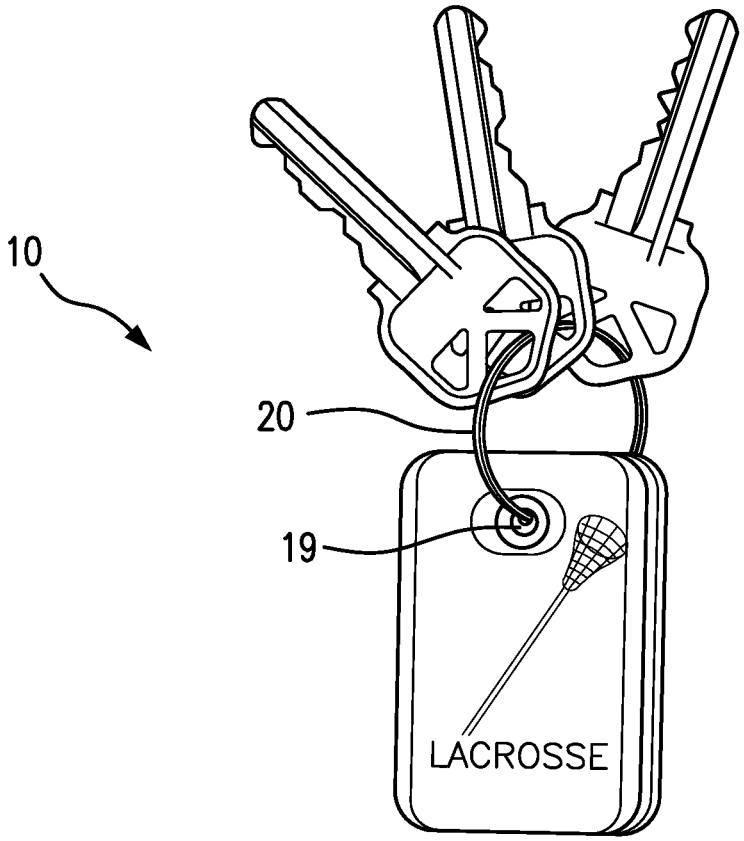
FIG. 3 is a perspective view of a composite magnetic tag according to the preferred embodiment of the present invention, illustrating the connection of the tag to a standard key ring.

As depicted in FIGS. 2 and 3, the composite magnetic tag 10 is assembled by attaching the magnetic surface 16 of the interior side 15 of each outer panel 11 to one of the faces of the central ferromagnetic plate 18, such that the circular apertures 17 align with one another to form a composite aperture 19. As illustrated in FIG. 3, the assembled composite tag can be attached to one or more items by a connective means 20—in this case a key ring—inserted through the composite aperture.

As illustrated in FIGS. 2 and 3, the assembled composite tag 10 displays the indicia 14 on the exterior sides 12 of the two outer panels 11. Accordingly, these indicia 14 can be changed by magnetically attaching different outer panels 11 to the central ferromagnetic plate 18. In this way, the composite tag 10 structure can be used for a wide variety of identification and/or decorative functions.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A composite magnetic tag, comprising:

two magnetic outer panels, consisting of a first outer panel and a second outer panel;

a central ferromagnetic plate;

wherein each of the magnetic outer panels has a magnetic interior side and a concave exterior side, which contains one or more indicia in the form of graphic designs, photographs and/or alphanumeric characters;

wherein the central ferromagnetic plate is a thin plate made of ferromagnetic metal, which substantially conforms to the size and shape of the two magnetic outer panels;

wherein each of the two magnetic outer panels attaches by its magnetic interior side to either face of the central ferromagnetic plate, thereby assembling a composite tag, in which the central ferromagnetic plate is sandwiched between the two magnetic outer panels, such that the indicia on the exterior sides of the magnetic outer panels are visible; and wherein the first outer panel has a circular aperture which aligns cooperatively with a corresponding aperture of the second outer panel and a corresponding aperture of the central ferromagnetic plate, such that a composite aperture is formed when the composite tag is assembled, and such that the assembled composite tag can be attached to one or more items by a connective means inserted through the composite aperture.

2. The composite magnetic tag of claim 1, wherein the magnetic outer panels are interchangeable with one or more replacement panels having the same form and structure as the magnetic outer panels but containing alternate indicia that differ from the indicia of the magnetic outer panels.

3. The composite magnetic tag of claim 2, wherein the central ferromagnetic plate has identity information engraved upon it.

* * * * *